US012305460B2

(12) United States Patent
Conner et al.

(10) Patent No.: US 12,305,460 B2
(45) Date of Patent: May 20, 2025

(54) HYDROSTATIC MODULE INTERLOCK, METHOD AND SYSTEM

(71) Applicant: Baker Hughes Oilfield Operations LLC, Houston, TX (US)

(72) Inventors: Nicholas S. Conner, Cypress, TX (US); Andrew John Vissotski, Pring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/240,895

(22) Filed: Aug. 31, 2023

(65) Prior Publication Data

US 2023/0407719 A1 Dec. 21, 2023

Related U.S. Application Data

(62) Division of application No. 17/517,167, filed on Nov. 2, 2021, now abandoned.

(51) Int. Cl.
*E21B 23/04* (2006.01)

(52) U.S. Cl.
CPC ..... *E21B 23/0411* (2020.05); *E21B 23/042* (2020.05)

(58) Field of Classification Search
CPC ..... E21B 23/00; E21B 23/0411; E21B 23/04; E21B 23/042
See application file for complete search history.

(56) References Cited

U.S. PATENT DOCUMENTS 3,136,364 A 6/1964 Myers
3,719,241 A 3/1973 Bell
(Continued)

FOREIGN PATENT DOCUMENTS

CN 110344780 A 10/2019
KR 100949102 B1 3/2010
WO 20200214440 A1 10/2020

OTHER PUBLICATIONS

Notification of Transmittal of the International Search Report and the Written Opinion of the International Searching Authority, or the Declaration; PCT/US2022/078844; Mail date: Mar. 2, 2023; 11 pages.

*Primary Examiner* — Shane Bomar
(74) *Attorney, Agent, or Firm* — Baker Hughes Patent Organization

(57) ABSTRACT

A hydrostatic module interlock for a downhole tool including a piston having fingers extending from a body thereof, a piston mandrel telescopically arranged with the piston, and a retaining piston disposed to prevent finger deflection in the first position and allow finger deflection in the second position. A method for actuating an interlocked tool including loading a release configuration to a threshold force, releasing the release configuration, moving a retaining piston out of a first position wherein the retaining piston physically impedes deflection of a finger of a piston, deflecting the finger out of engagement with a piston mandrel telescopically arranged relative to the piston, and moving the piston relative to the piston mandrel. A borehole system including a borehole in a subsurface formation, a string disposed in the borehole, and a hydrostatic module interlock disposed within or as a part of the string.

13 Claims, 14 Drawing Sheets

(56) References Cited

U.S. PATENT DOCUMENTS

| | | | | |
|---|---|---|---|---|
| 3,866,695 | A | | 2/1975 | Jackson |
| 4,448,254 | A | | 5/1984 | Barrington |
| 4,691,779 | A | * | 9/1987 | McMahan ..... E21B 49/001 166/321 |
| 4,880,056 | A | | 7/1989 | Nelson et al. |
| 4,915,172 | A | | 4/1990 | Donovan et al. |
| 5,109,925 | A | | 5/1992 | Stepp et al. |
| 5,167,284 | A | | 12/1992 | Leismer |
| 5,778,980 | A | | 7/1998 | Comeau et al. |
| 5,819,854 | A | | 10/1998 | Doane et al. |
| 5,992,520 | A | | 11/1999 | Schultz et al. |
| 6,073,698 | A | | 6/2000 | Schultz et al. |
| 6,186,227 | B1 | | 2/2001 | Vaynshteyn et al. |
| 6,315,050 | B2 | | 11/2001 | Vaynshteyn et al. |
| 6,382,319 | B1 | | 5/2002 | Hill, Jr. et al. |
| 6,564,876 | B2 | | 5/2003 | Vaynshteyn et al. |
| 7,836,961 | B2 | | 11/2010 | Li et al. |
| 7,913,770 | B2 | | 3/2011 | Schramm et al. |
| 8,322,450 | B2 | | 12/2012 | Meijer |
| 9,068,414 | B2 | | 6/2015 | Doane |
| 2009/0114400 | A1 | | 5/2009 | Obrejanu |
| 2018/0045004 | A1 | | 2/2018 | O'Connor |
| 2018/0274330 | A1 | | 9/2018 | Sim et al. |
| 2020/0332622 | A1 | | 10/2020 | Fadhil et al. |
| 2021/0095530 | A1 | | 4/2021 | Radtke et al. |
| 2023/0138954 | A1 | | 5/2023 | Connor et al. |

* cited by examiner

HYDROSTATIC MODULE INTERLOCK, METHOD AND SYSTEM

CROSS REFERENCE TO RELATED APPLICATIONS

This application is a divisional application that claims the benefit of an earlier filing date from U.S. Non-Provisional application Ser. No. 17/517,167 filed Nov. 2, 2021, the entire disclosure of which is incorporated herein by reference.

BACKGROUND

In the resource recovery and fluid sequestration industries, actuation configurations that rely on hydrostatic pressure in some way are prevalent. Often such configurations include an atmospheric or other lower pressure chamber that is used relative to hydrostatic pressure in a downhole environment to cause a mechanical device to move. Interlocks are sometimes desired since it may be possible to experience early actuation of hydrostatic driven configurations. It is well known that early actuation in a downhole environment is costly and hence to be avoided. Interlocks have been used and generally function well but they take up wall thickness in many tools that employ them. If wall thickness is available without requiring the outside diameter to be large than the available space in the borehole or without requiring the inside diameter to be such that flow therethrough is restricted, then such interlocks are fine. Where one or both of these issues are presented however, commercially available interlock systems fail to support the industry need. The art will well receive solutions to this issue.

SUMMARY

An embodiment of a hydrostatic module interlock for a downhole tool including a piston having fingers extending from a body thereof, a piston mandrel telescopically arranged with the piston, and a retaining piston disposed to prevent finger deflection in the first position and allow finger deflection in the second position.

An embodiment of a method for actuating an interlocked tool including loading a release configuration to a threshold force, releasing the release configuration, moving a retaining piston out of a first position wherein the retaining piston physically impedes deflection of a finger of a piston, deflecting the finger out of engagement with a piston mandrel telescopically arranged relative to the piston, and moving the piston relative to the piston mandrel.

A borehole system including a borehole in a subsurface formation, a string disposed in the borehole, and a hydrostatic module interlock disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Referring to FIGS. 1-4, a tool having a hydrostatic module interlock 10 is illustrated. The tool may be of any type (such as a packer) that uses hydrostatic pressure to move in some way and requires that control be maintained over actuation timing. The interlock 10 as disclosed herein provides highly reliable lockout of the hydrostatic module until threshold conditions are met. The art has found that with increasing demand for high pressure downhole systems for production, injection and sequestration, for example, issues regarding wall thickness for burst and collapse ratings are presented that conflict with desired bore diameter dimension. The interlock 10 solves the problem by supporting a larger bore diameter with standard size outside diameter while also producing an acceptable burst/collapse rating.

Figure 1:
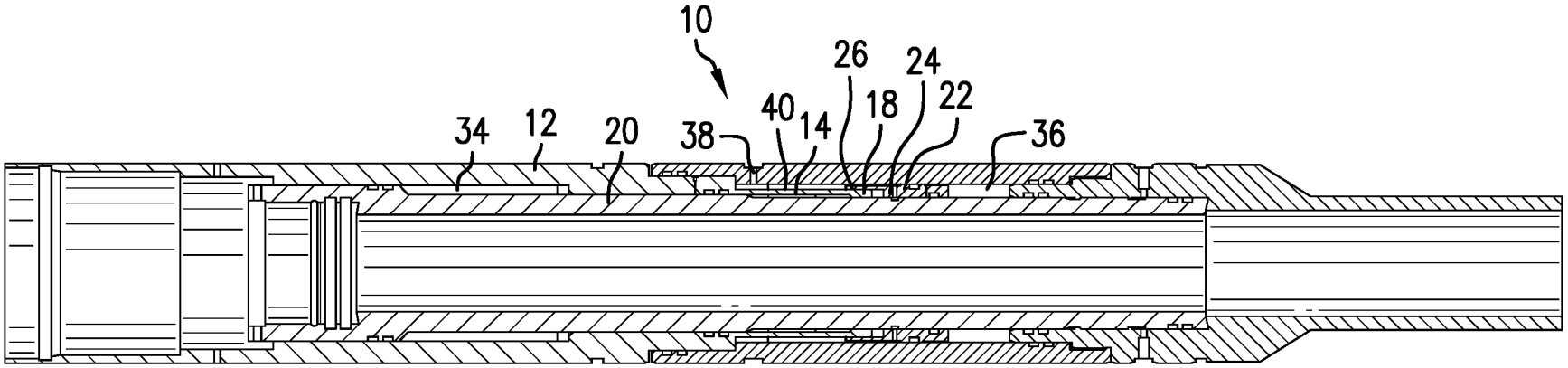
FIG. 1 is a cross sectional view of a tool having a hydrostatic module interlock in a first position.
Figure 2:
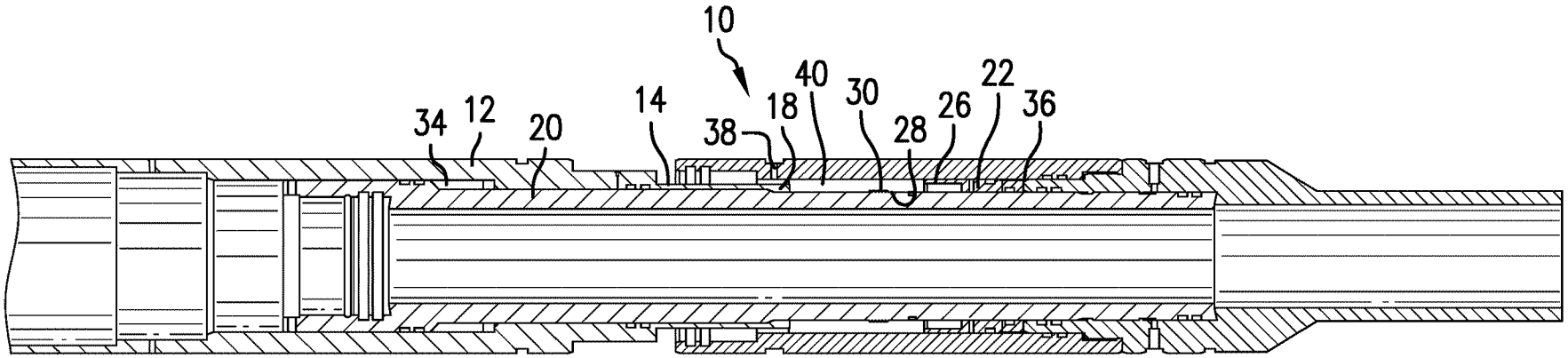
FIG. 2 is the view of FIG. 1 in a second position.
Figure 3:
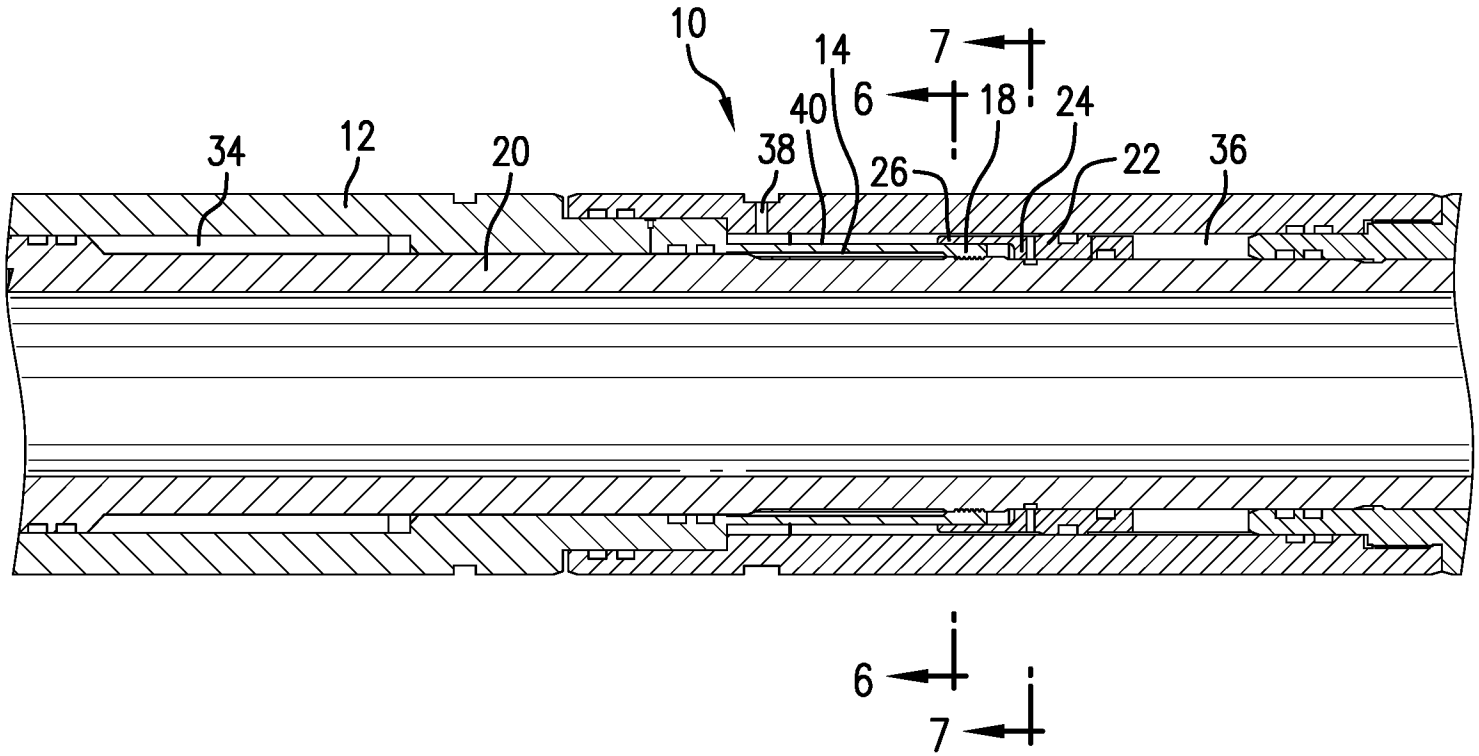
FIG. 3 is an enlarged view of a portion of FIG. 1 to illustrate the components in the first position.
Figure 4:
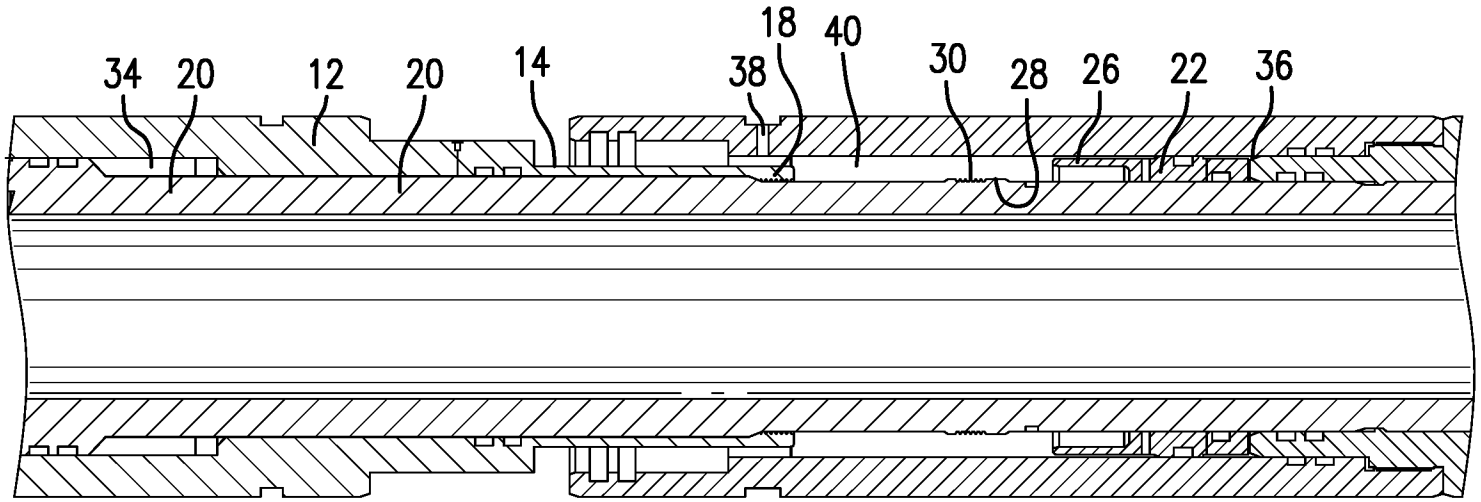
FIG. 4 is an enlarged view of a portion of FIG. 2 to illustrate the components in the second position.
Figure 5:
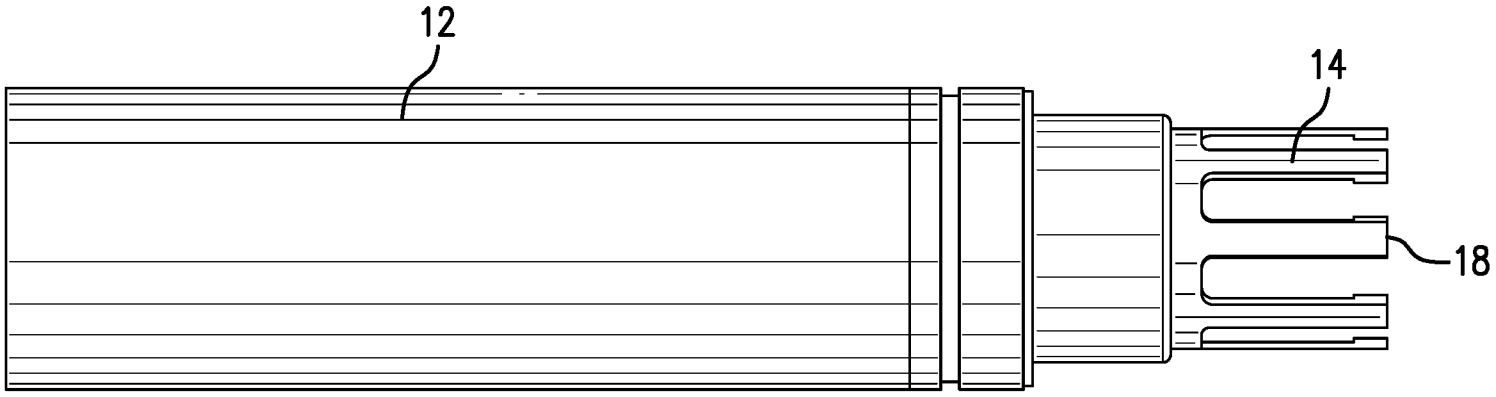
FIG. 5 is view of a setting piston of the hydrostatic module interlock of FIG. 1 apart from other components.
Figure 6:
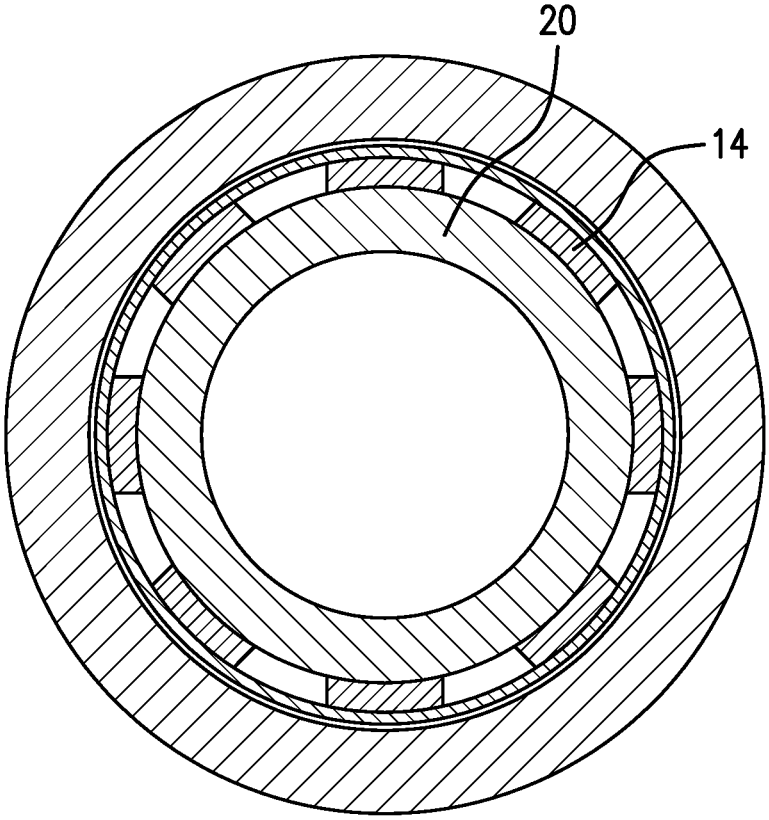
FIG. 6 is a cross sectional view taken from FIG. 1 along section line 6-6.
Figure 7:
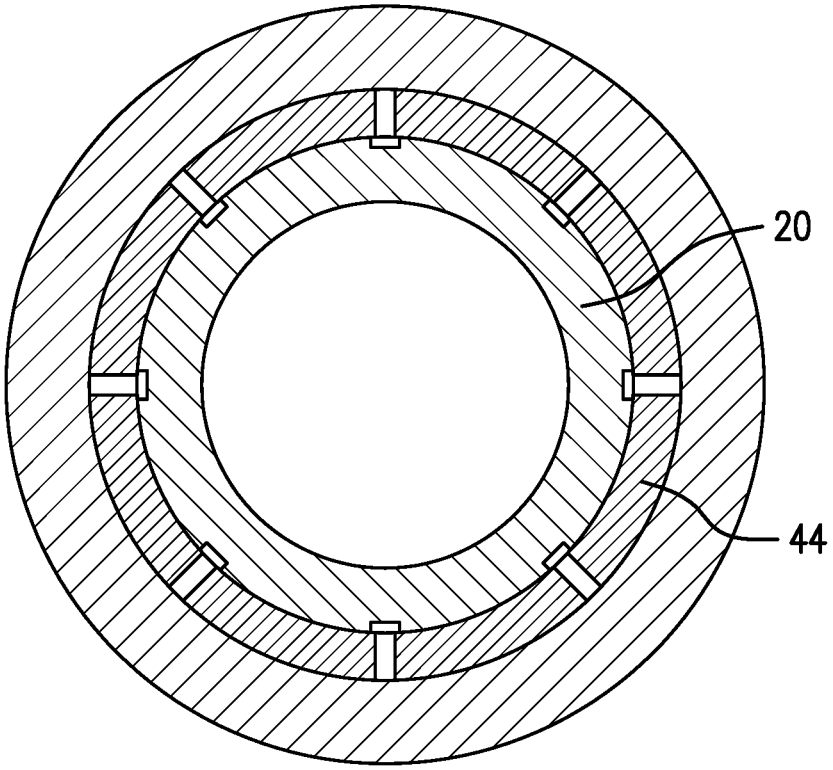
FIG. 7 is a cross sectional view taken from FIG. 1 along section line 7-7.
Figure 8:
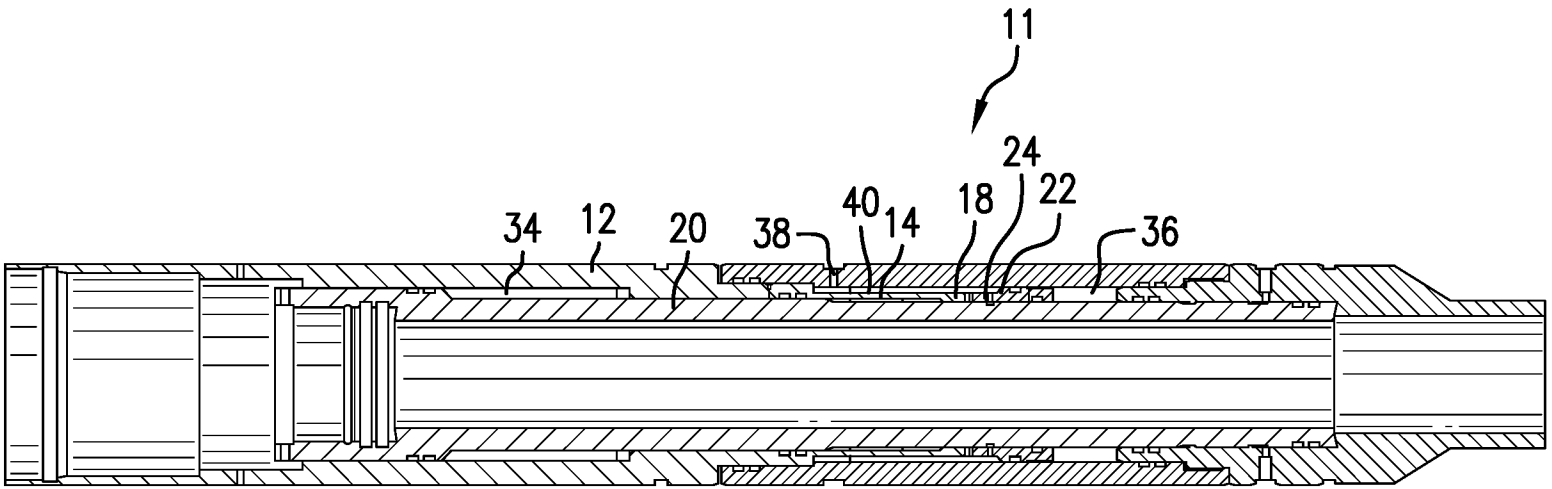
FIG. 8 is a cross sectional view of another embodiment of a tool having a hydrostatic module interlock in a first position.
Figure 9:
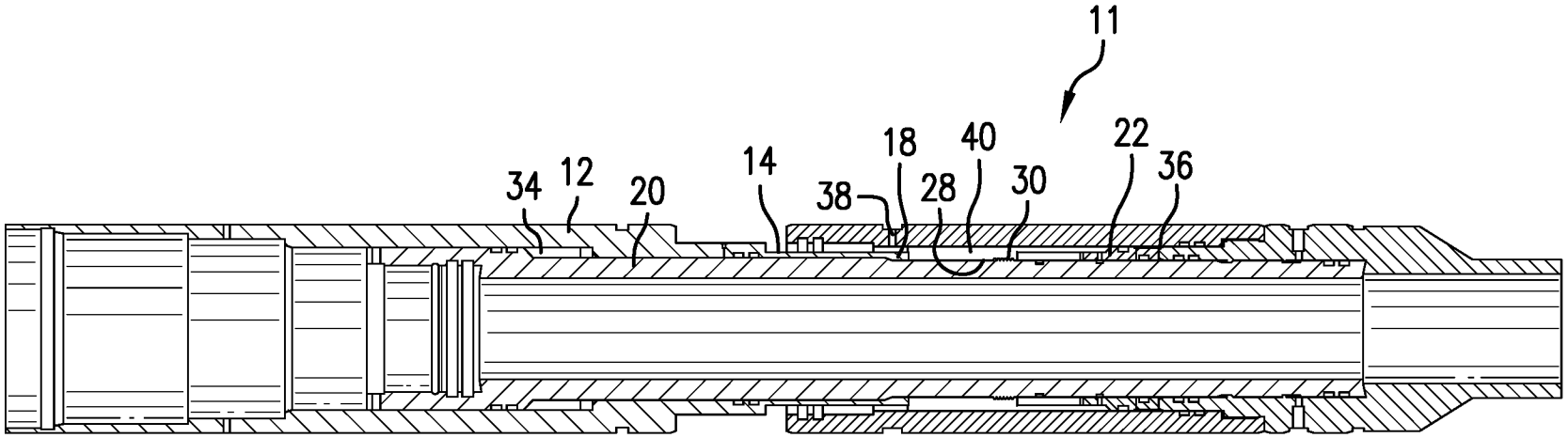
FIG. 9 is the view of FIG. 8 in a second position.
Figure 10:
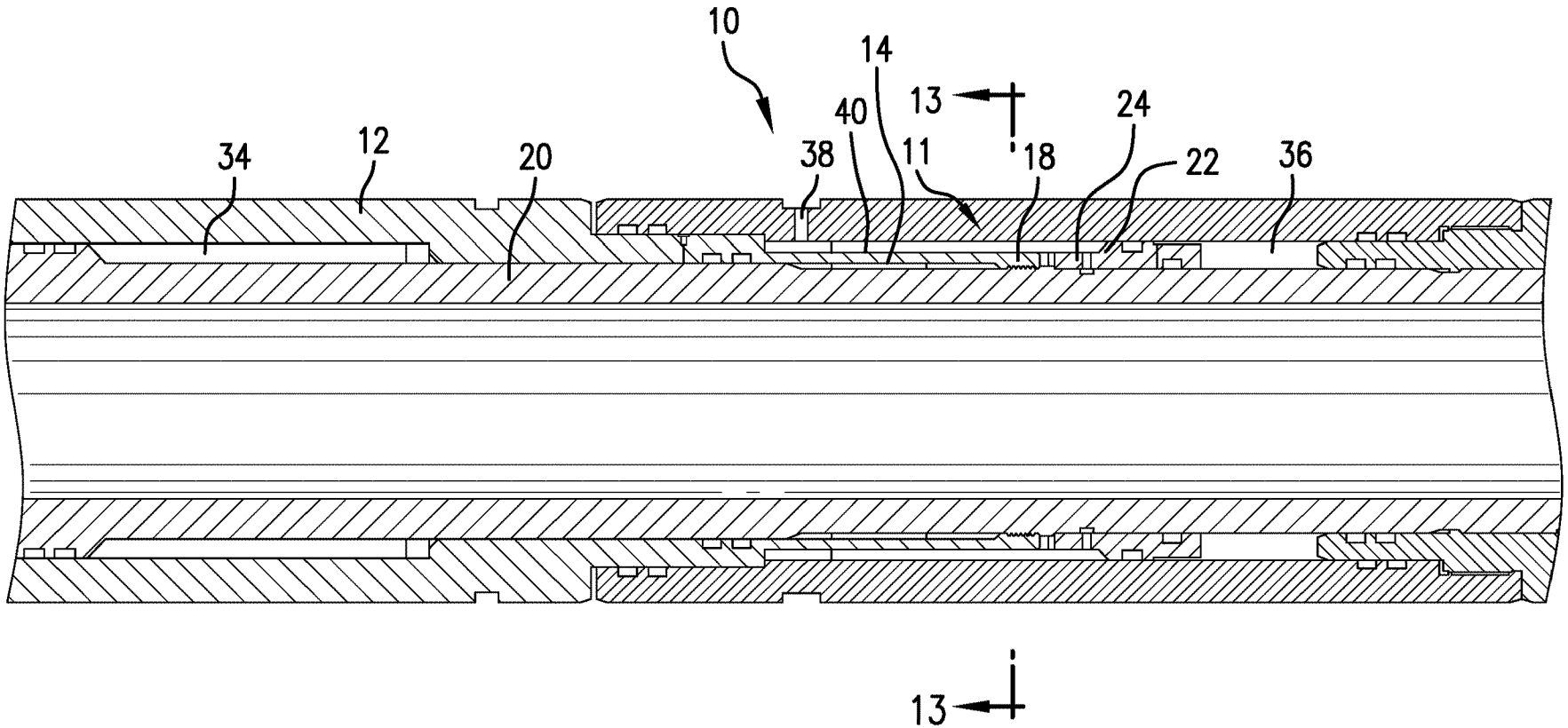
FIG. 10 is an enlarged view of a portion of FIG. 8 to illustrate the components in the first position.
Figure 11:
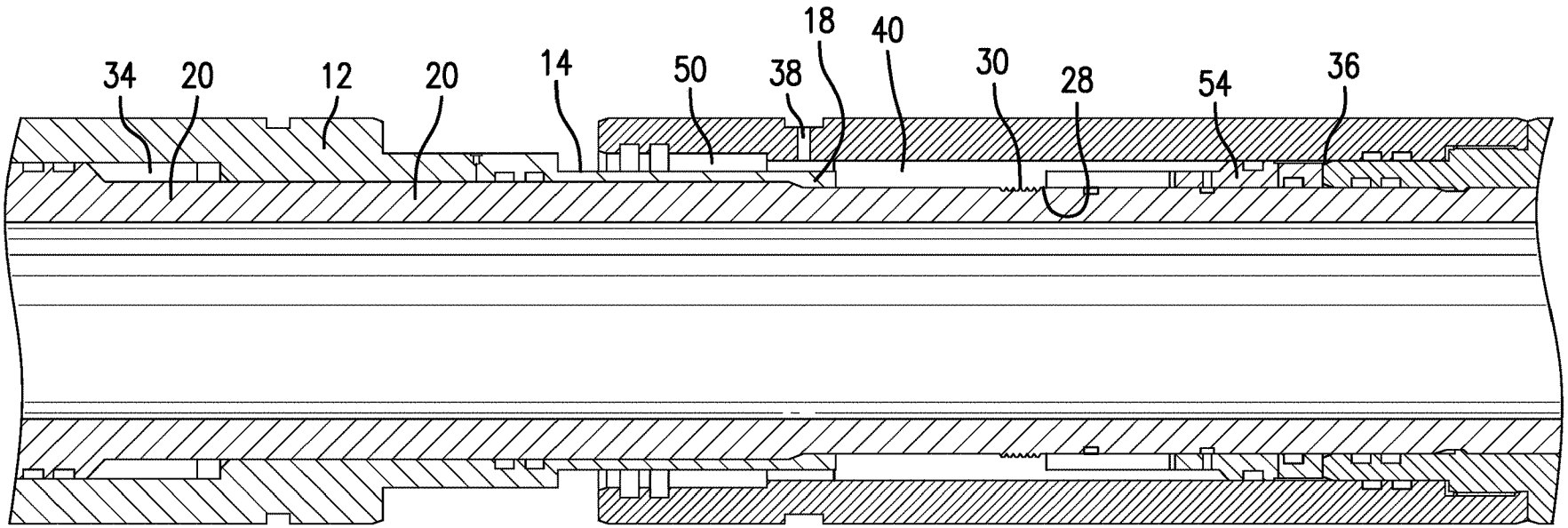
FIG. 11 is an enlarged view of a portion of FIG. 9 to illustrate the components in the second position.
Figure 12:
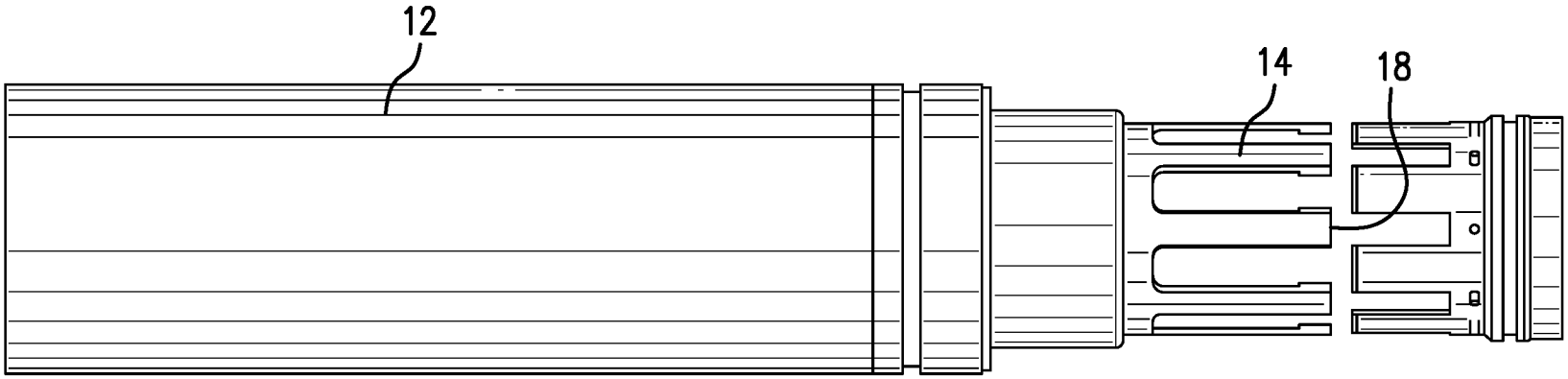
FIG. 12 is view of a setting piston of the hydrostatic module interlock of FIG. 8 apart from other components.

The interlock 10 includes a piston 12 having a number of fingers 14 extending from a body 16 of the piston 12. The fingers 14 are deflectable fingers such as collet fingers and may include gripping ends 18. Gripping ends 18 may be toothed structures, wickers, or may simply be of a slightly larger radial dimension such that the fingers, and hence the piston 12 cannot move longitudinally along a piston mandrel 20, with which the gripping ends 18 are engaged if the fingers 14 cannot deflect. A retaining piston 22 is slidably disposed upon the piston mandrel 20 and engageable with the fingers 14 to prevent the fingers 14 deflecting until the retaining piston is moved from engagement with fingers 14. In an embodiment, the retaining piston 22 cannot move along the piston mandrel 20 until a threshold force is applied that will cause release of a release configuration 24, which in some embodiments may be a release member or shear member. In the embodiment of FIGS. 1-7, the retaining piston 22 includes a ring 26 that engages with the fingers 14 in a first position. The ring 26 is illustrated engaging a radially outwardly positioned perimetrical surface of the fingers 14 to physically impede radially outward deflection of the fingers 14. It is also possible that the ring 26 could be configured to be received in an annularly shaped recess in the ends of fingers 14. This provides the same result that while in the first position, the fingers 14 cannot be deflected radially outwardly. Without radial deflection, the fingers cannot disengage from the piston mandrel 20 for longitudinal movement relative thereto. The embodiment that places the ring 26 radially outwardly of the perimetric surface of the fingers 14 is easily appreciated from FIGS. 3 and 4 where the first and second positions of the interlock 10 are illustrated sequentially. The cross-section views of FIGS. 6 and 7 make evident the radially outwardly defected position of fingers 14 (FIG. 6) and the radially undeflected position of the fingers 14 (FIG. 7). In some variations of the embodiment of FIGS. 1-7, the piston mandrel 20 may include a gripping feature 28 to engage with the gripping ends 18 in the first position of interlock 10. As illustrated the feature 28 may be wickers 30, for example, that engage the gripping ends 18. In use, the interlock 10 begins in the first position, which is shown in FIG. 1. Pressure in chambers 34 and 36 is atmospheric (or otherwise lower than hydrostatic in the target environment). Hydrostatic pressure is delivered through port 38 to chamber 40 whereat the retaining piston 22 is hydraulically loaded against the atmospheric chamber 36. With the differential pressure experienced across retaining piston 22, the release configuration 24 is loaded to the threshold force and releases. Continued hydraulic pressure causes the retaining piston 22 to move rightwardly in the figure and out of contact with the fingers 14. This is illustrated in FIG. 2 although FIG. 2 is also after the piston 12 is moved leftwardly in the Figure. The piston 12 is moved all the way to the left (second) position because the hydrostatic pressure through port 38 creates a differential across piston 12 relative to atmospheric chamber 34. The differential makes the piston 12 want to move such that once the retaining capability of the fingers 14 being locked to the piston mandrel 20 is released, piston 12 will indeed move leftwardly of the Figure.

Figure 13:
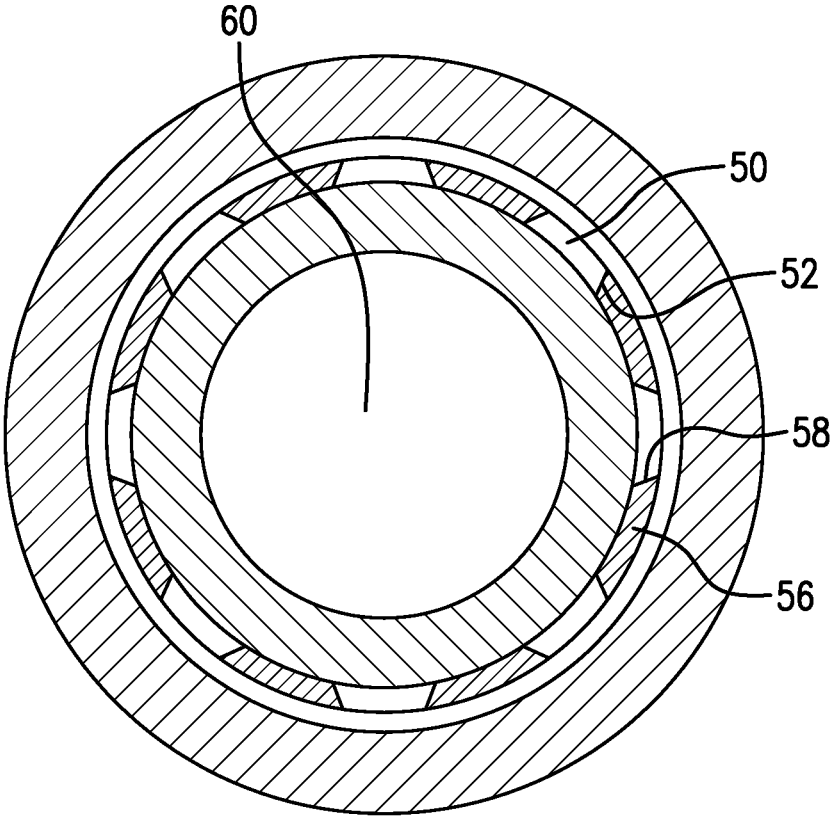
FIG. 13 is a cross sectional view taken from FIG. 10 along section line 13-13.

In another embodiment, referring to FIGS. 8-12, interlock 11 includes many working parts identical to (or nearly so) interlock 10 and these will not be directly addressed. Rather, the distinctions between interlocks 10 and 11 are addressed while unaddressed components and workings will be understood to be the same. The distinction for this embodiment is in fingers 50 (similar to fingers 14) and the retaining piston 54 (similar to retaining piston 22). While the FIGS. 8-12 are helpful for understanding of the embodiment, it is FIG. 13 that provides the greatest elucidation of the distinction of this embodiment to the embodiment of FIG. 1. The fingers 50 include side walls 52 while the retaining piston 54 includes appendages 56 having side walls 58. Each of the side walls is at an angle that is non radial relative to a center axis 60 of the entire interlock 11. By viewing FIG. 13, one can appreciate that with retaining piston appendages 56 engaged with fingers 50, the fingers are not permitted to deflect radially outwardly. The angles of the side walls 52 and 58 as shown prevents such deflection. In other respects, this embodiment works identically to the foregoing embodiment with the difference being that instead of removing the ring 26 from engagement with the fingers 14, the appendages 56 are removed from engagement with the fingers 50 instead.

Figure 14:
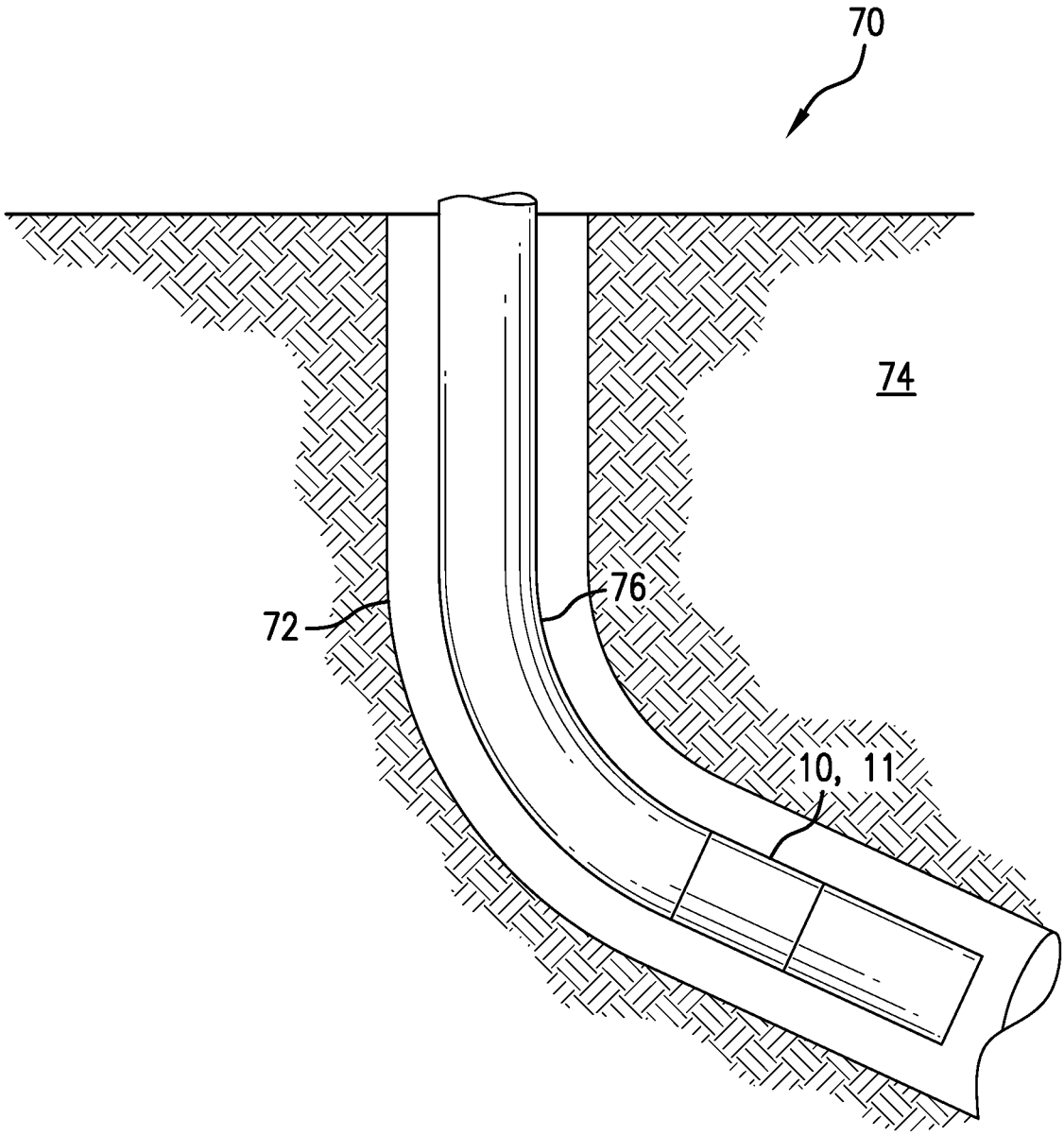
FIG. 14 is a view of a borehole system including the hydrostatic module interlock as disclosed herein.

Referring to FIG. 14, a borehole system 70 comprises a borehole 72 in a subsurface formation 74. Disposed in the borehole 72 is a string 76. Disposed within or as a part of the string 76 is an interlock 10 or 11 as disclosed above.

Set forth below are some embodiments of the foregoing disclosure:

Embodiment 1: A hydrostatic module interlock for a downhole tool including a piston having fingers extending from a body thereof, a piston mandrel telescopically arranged with the piston, and a retaining piston disposed to prevent finger deflection in the first position and allow finger deflection in the second position.

Embodiment 2: The interlock as in any prior embodiment wherein the piston fingers include gripping ends.

Embodiment 3: The interlock as in any prior embodiment wherein the gripping ends are teeth.

Embodiment 4: The interlock as in any prior embodiment wherein the fingers are collet fingers.

Embodiment 5: The interlock as in any prior embodiment wherein the mandrel includes a feature to engage the gripping ends.

Embodiment 6: The interlock as in any prior embodiment wherein the retaining piston includes a ring adjacent perimetrical surfaces of the fingers.

Embodiment 7: The interlock as in any prior embodiment wherein the retaining piston includes retaining appendages engaged with the fingers when in the first position.

Embodiment 8: The interlock as in any prior embodiment wherein the appendages are interspersed with the fingers.

Embodiment 9: The interlock as in any prior embodiment wherein the appendages include non radial angled side surfaces that engage finger side surfaces thereby preventing radial deflection of the fingers while the retaining piston is in the first position.

Embodiment 10: The interlock as in any prior embodiment, further including a release configuration preventing movement of the retaining piston from the first position to the second position.

Embodiment 11: The interlock as in any prior embodiment, wherein the release configuration releases at a threshold force on the retaining piston.

Embodiment 12: The interlock as in any prior embodiment, wherein the release configuration is a shear member.

Embodiment 13: A method for actuating an interlocked tool including loading a release configuration to a threshold force, releasing the release configuration, moving a retaining piston out of a first position wherein the retaining piston physically impedes deflection of a finger of a piston, deflecting the finger out of engagement with a piston mandrel telescopically arranged relative to the piston, and moving the piston relative to the piston mandrel.

Embodiment 14: The method as in any prior embodiment wherein the moving of the retaining piston is moving a ring out of contact with a perimetrical surface of the finger.

Embodiment 15: The method as in any prior embodiment wherein the moving of the retaining piston is moving a retaining appendage out of contact with a side surface of the finger.

Embodiment 16: A borehole system including a borehole in a subsurface formation, a string disposed in the borehole, and a hydrostatic module interlock as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A hydrostatic module interlock for a downhole tool comprising:

a piston having fingers extending from a body thereof;

a piston mandrel telescopically arranged with the piston; and a retaining piston having retaining appendages engaged with the fingers to prevent finger deflection in a first position and allow finger deflection in a second position.

2. The interlock as claimed in claim 1 wherein the piston fingers include gripping ends.

3. The interlock as claimed in claim 2 wherein the gripping ends are teeth.

4. The interlock as claimed in claim 1 wherein the fingers are collet fingers.

5. The interlock as claimed in claim 2 wherein the mandrel includes a feature to engage the gripping ends.

6. The interlock as claimed in claim 1 wherein the appendages are interspersed with the fingers.

7. The interlock as claimed in claim 1 wherein the appendages include non-radial angled side surfaces that engage finger side surfaces thereby preventing radial deflection of the fingers while the retaining piston is in the first position.

8. The interlock as claimed in claim 7 wherein the fingers include non-radial angled side surfaces.

9. The interlock as claimed in claim 1, further comprising a release configuration preventing movement of the retaining piston from the first position to the second position.

10. The interlock as claimed in claim 9, wherein the release configuration releases at a threshold force on the retaining piston.

11. The interlock as claimed in claim 9, wherein the release configuration is a shear member.

12. A method for actuating an interlocked tool comprising:

loading a release configuration to a threshold force;

releasing the release configuration;

moving a retaining piston out of a first position wherein the retaining piston physically impedes deflection of a finger of a piston by engaging an appendage of the retaining piston circumferentially with the finger to a second position wherein the appendage is out of contact with the finger;

deflecting the finger out of engagement with a piston mandrel telescopically arranged relative to the piston; and moving the piston relative to the piston mandrel wherein the moving is disengaging a non-radial side surface of the finger with a non-radial side surface of the appendage.

13. A borehole system comprising:

a borehole in a subsurface formation;

a string disposed in the borehole; and a hydrostatic module interlock as claimed in claim 1 disposed within or as a part of the string.

* * * * *